US008313471B2

(12) United States Patent
Hendricks

(10) Patent No.: US 8,313,471 B2
(45) Date of Patent: Nov. 20, 2012

(54) THERAPEUTIC ARTHRITIS GLOVE WITH EXPANDABLE GOLD RINGS

(75) Inventor: Jeffrey P. Hendricks, Grandville, MI (US)

(73) Assignee: Teresa Hendricks, Grand Rapids, MI (US)

( * ) Notice: Subject to any disclaimer, the term of this patent is extended or adjusted under 35 U.S.C. 154(b) by 111 days.

(21) Appl. No.: 13/017,598

(22) Filed: Jan. 31, 2011

(65) Prior Publication Data

US 2011/0190715 A1 Aug. 4, 2011

Related U.S. Application Data

(60) Provisional application No. 61/299,732, filed on Jan. 29, 2010.

(51) Int. Cl.

| | |
|---|---|
| ***A61M 35/00*** | (2006.01) |
| ***A41D 13/08*** | (2006.01) |
| ***A41D 19/00*** | (2006.01) |
| ***A61H 5/00*** | (2006.01) |
| ***A61F 5/00*** | (2006.01) |

(52) U.S. Cl. ..... 604/292; 2/21; 2/159; 2/161.7; 601/5; 601/11; 602/21; 602/22; 607/51

(58) Field of Classification Search ..... None
See application file for complete search history.

(56) References Cited

U.S. PATENT DOCUMENTS

| | | | | |
|---|---|---|---|---|
| 1,708,757 | A | 4/1929 | Freileweh | |
| 4,173,218 | A | 11/1979 | Cronin | |
| 4,606,354 | A | 8/1986 | Jacob | |
| 4,932,396 | A | 6/1990 | Garris | |
| 5,207,706 | A | 5/1993 | Menaker | |
| 5,697,103 | A | 12/1997 | Wiggins | |
| 6,554,783 | B2 | 4/2003 | McEvoy | |
| 6,694,523 | B2 | 2/2004 | Hurst | |
| 7,731,633 | B1 * | 6/2010 | Williams | 482/47 |
| 2002/0006962 | A1 * | 1/2002 | Wang et al. | 514/640 |

* cited by examiner

*Primary Examiner* — Jackie Ho
*Assistant Examiner* — Joshua Lee
(74) *Attorney, Agent, or Firm* — John A. Waters; Waters and Associates PLC

(57) ABSTRACT

A therapeutic glove of elastic synthetic fabric to which gold-coated self-expanding ring devices are affixed at selective locations adjacent the metacarpophalangeal (MCP) joints of the fingers of the hand without restricting movement of those joints. The affixing of rings on the interior of the glove along the MCP joints induces optimal gold abrasion therapy of joints that are afflicted by rheumatoid arthritis. The high purity gold-coating on the rings, combined with the snugness of the glove, increases the natural abrasion and absorption of the gold into the joint, which has the therapeutic effect of delaying joint erosion with daily wear.

8 Claims, 6 Drawing Sheets

FIG. 9
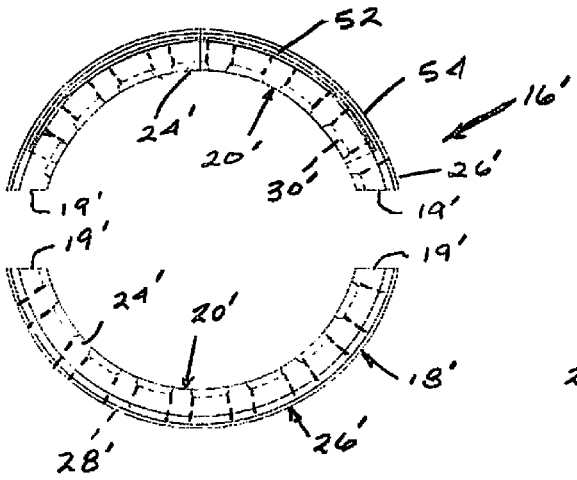
FIG. 8
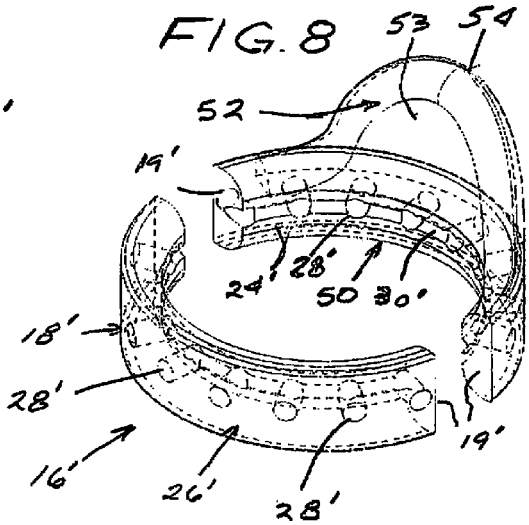
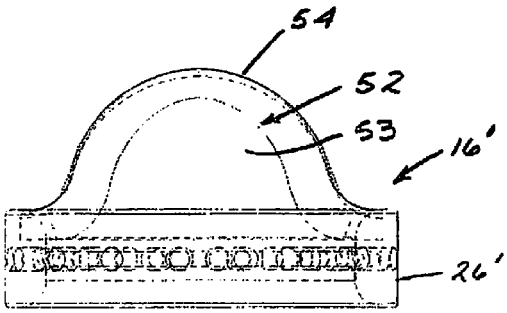
FIG. 11
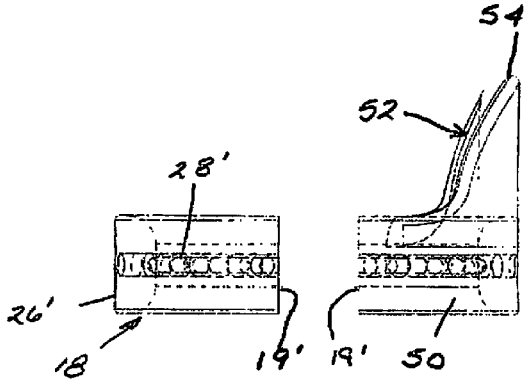
FIG. 10

THERAPEUTIC ARTHRITIS GLOVE WITH EXPANDABLE GOLD RINGS

CROSS-REFERENCE TO RELATED APPLICATIONS

The present application claims the benefit of applicant's provisional application, Ser. No. 61/299,732, filed Jan. 29, 2010.

BACKGROUND OF THE INVENTION

The present invention relates to therapeutic and orthopedic devices, more specifically to a therapeutic glove for use with arthritically stricken hands. Rheumatoid Arthritis (RA) is a chronic autoimmune disease with inflammation of the joints and marked deformities. It is a progressively crippling disease with no known cure. The disease causes deformity and instability of joints that result in functional losses in the hand. Even though RA can affect any synovial joint, the metacarpophalangeal (MCP) is the most common site of involvement and is critical for proper finger function. As RA progresses in individuals, the MCP joints in the hand are involved, causing loss of manual dexterity. Loss of such dexterity and hand function leaves those afflicted incapable of performing routine acts of normal daily living, including buttoning, tying, and basics of dressing and hygiene.

The Arthritis Foundation estimates (2009) the number of individuals afflicted with arthritis in the U.S. is 46 million. Arthritis and rheumatic conditions cost the U.S. economy 128 billion dollars (2003). Arthritis is the second most frequently reported chronic condition in the United States. It is caused by inflammation of the joints, which erode, stiffen and deform over time. Early intervention with a treatment program is optimal to minimize joint erosion.

Various treatments exist to relieve joint pain and prevent further damage to the joint tissue by reducing the inflammation, such as immobilization, medication, application of heat and pressure, and splinting. Gold as a component of medicine, has also been used to treat rheumatic disease since the turn of the century. However, gold accumulates in much smaller amounts in joint tissues than in other areas of the body, such as the bone marrow, and the use of ingested gold is associated with some health risks. In some treatments of joints, use of gold-coated implants or injections of gold or gold-containing lotions are used to reduce joint erosion and relieve pain, though precisely how it works remains a mystery. It is well known that the efficacy of gold has been well supported in many studies. Studies have also shown that patients with rheumatoid arthritis (RA) who wear gold rings may have delayed disease progression in the ringed and adjacent joints. In a study of left ring finger joints of 30 long-term ring wearers and 25 long-term non-ring wearers, x-rays showed significant delayed disease progression in the ringed and adjacent joints. Gold from the rings apparently passes through the skin into the local lymph glands down to the knuckle joint. Gold pieces of jewelry are known to continually abrade during the time they are worn and with certain activities or exterior forces can abrade at greater quantities.

Another type of treatment for arthritis is by immobilization, where splint type devices are used to hold the fingers in extension or to realign angularly deviated fingers to improve hand functions. Such splints share one or more undesirable attributes. Typically, splints are manufactured with bulky materials and wire outriggers. Splints cause the fingers to abduct (spread out) when wearing them. Splints immobilize the wearer's hand from being able to perform tasks that require manual dexterity, from dressing oneself to typing.

In another treatment for temporarily relieving some of the symptoms of arthritic hands or skin conditions, compression gloves continuously apply pressure to the hand for long periods of time. However, the beneficial effects of compression gloves are temporary and do not provide lasting relief.

SUMMARY OF THE INVENTION

The present invention provides a lightweight, snug-fitting expandable glove wherein self-expanding gold-coated ring segments affixed on the interior of the finger portions of the glove surround the MCP joints of wearers. The gloves provide automatically adjustable gold bands that fit on different finger sizes and maximize the therapeutic effect of the gold on the affected finger joints, while providing a comfortable compression fit without interfering with the wearer's manual dexterity. The use of rings formed with a thin layer of gold permits the use of high purity gold while minimizing the expense of the product.

In the present invention, the hand is inserted into the stretchy, form-fitting glove material and the affixed interior gold-coated rings self-expand and contract as the wearer's joints pass through them. The rings then rest snuggly around the circumference of the MCP joint, tightly encircling the joints while the gloves are worn.

Another important feature is that the present invention combines the benefits of the gold rings with reducing inflammation with light pressure that comes from a snug-fitting, stretchy glove fabric. More importantly, though, this compression on the hand creates friction between the surface area of the fingers and the gold-coating on the rings, which optimizes the abrasion of gold against the fingers adjacent the joints and the beneficial effects therefrom, slowing the progression of RA in finger joints and impeding joint erosion.

BRIEF DESCRIPTION OF THE SEVERAL VIEWS OF THE DRAWING

FIG. 8 is a perspective view of a second embodiment of a split ring band incorporated into the fingers of the glove of the present invention, wherein the band includes an axially extending flange that extends toward the MCP joint of the wearer.

FIG. 9 is an axial end view of the band of FIG. 8.

FIG. 10 is a side view of the band of FIG. 8.

FIG. 11 is a top view of the band of FIG. 8.

DETAILED DESCRIPTION OF THE PREFERRED EMBODIMENT

Figure 1:
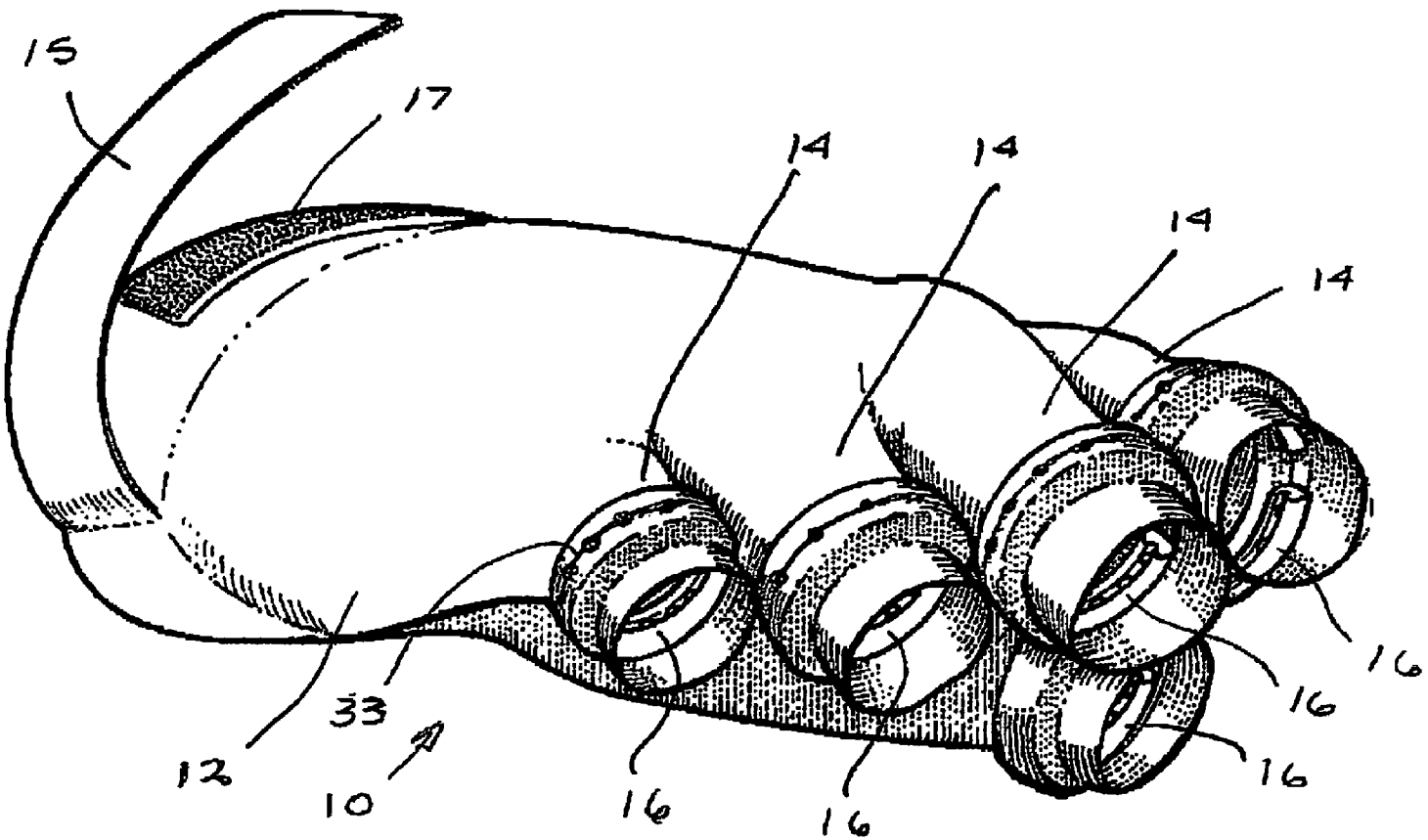
FIG. 1 is a perspective view of the therapeutic glove of the present invention showing the side of the glove and the ends of the fingers.
Figure 2:
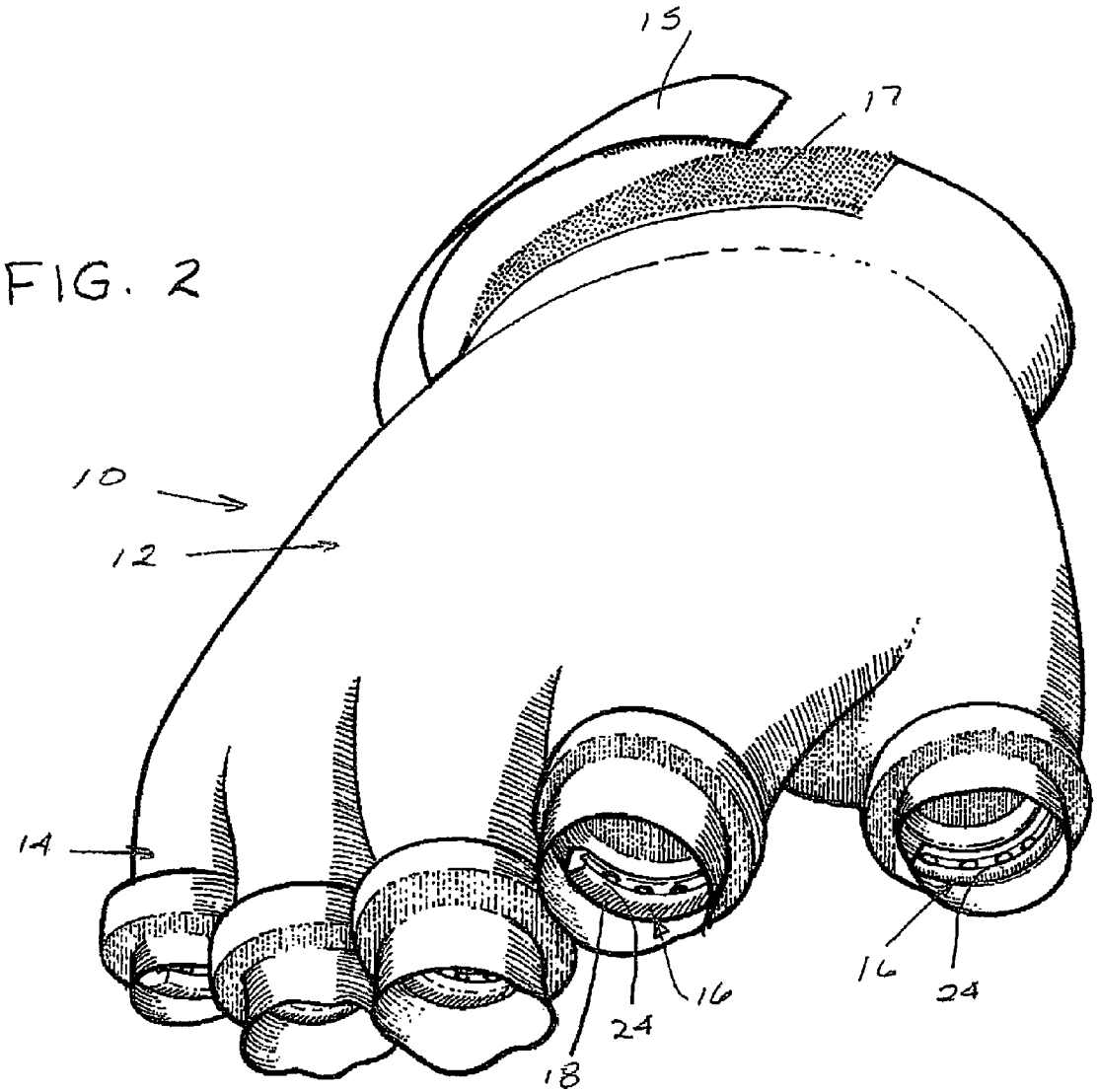
FIG. 2 is a perspective view of the arthritis glove of FIG. 1 showing the top of the glove and the ends of the fingers.
Figure 3:
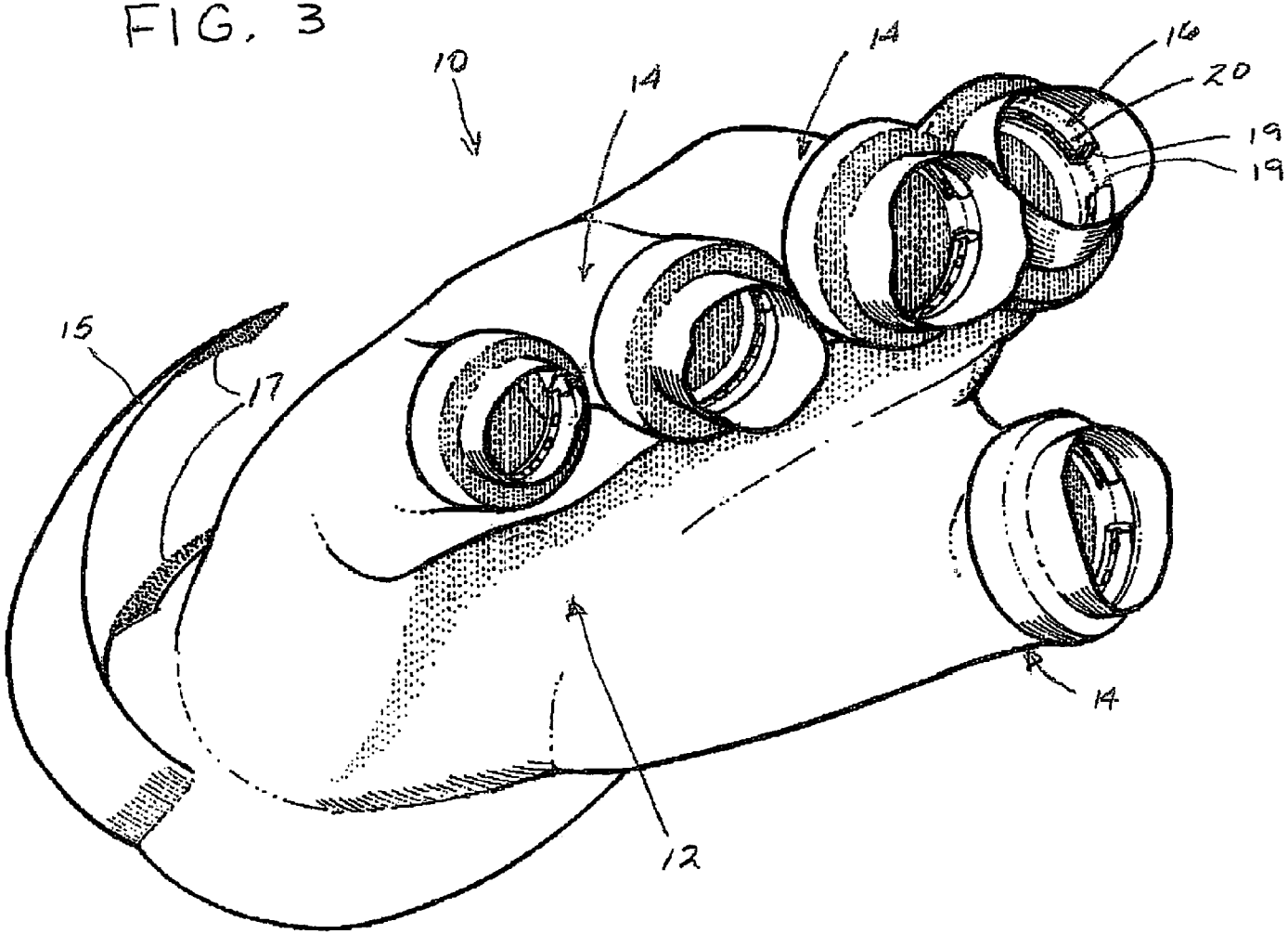
FIG. 3 is another perspective view of the therapeutic glove of FIG. 1, showing the palm of the glove and the ends of the fingers.
Figure 4:
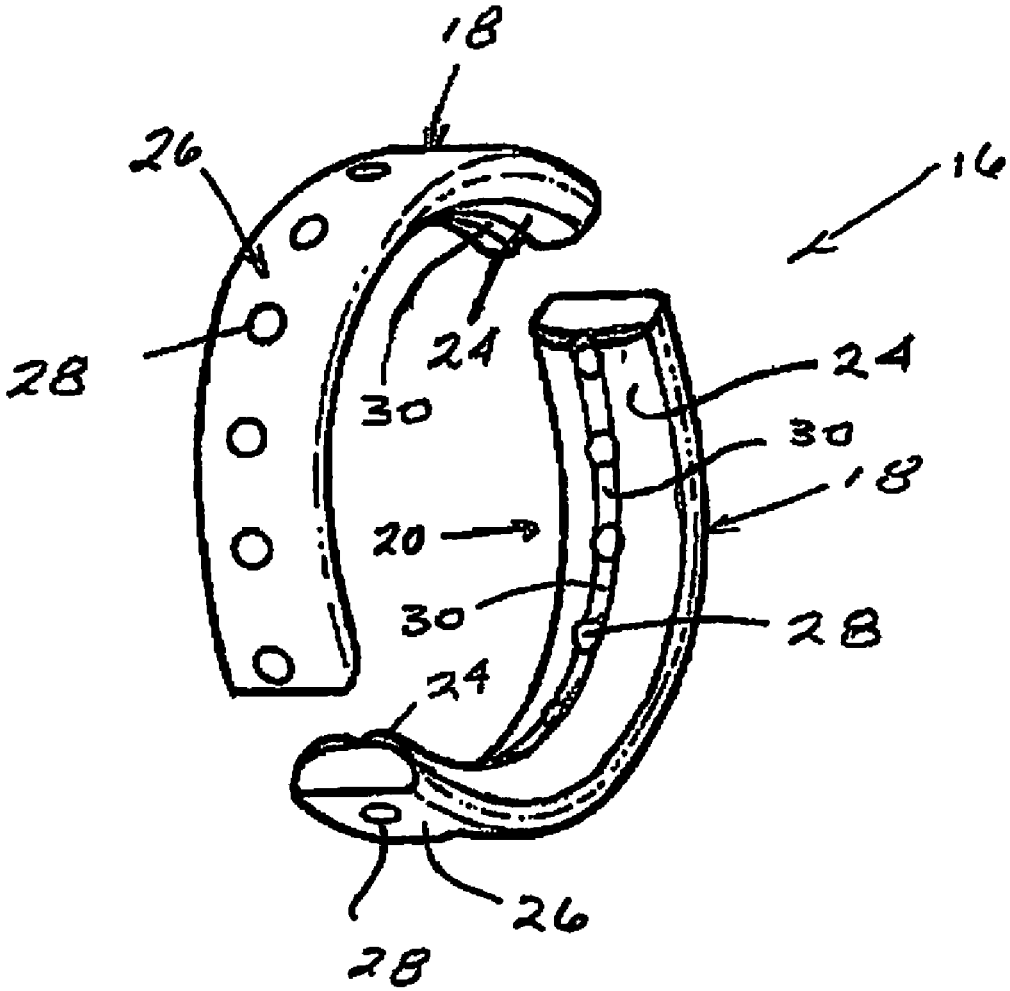
FIG. 4 is a perspective view of a first embodiment of the split ring bands incorporated into the fingers of the glove of the present invention.
Figure 7:
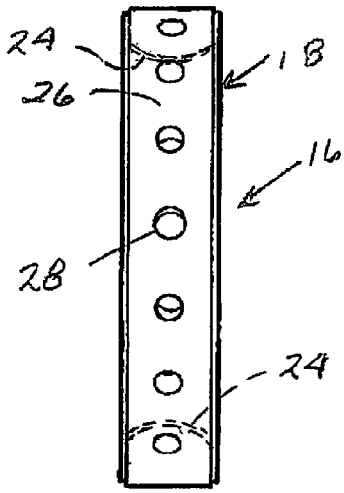
FIG. 7 is a top edge view of the band of FIG. 5.
Figure 5:
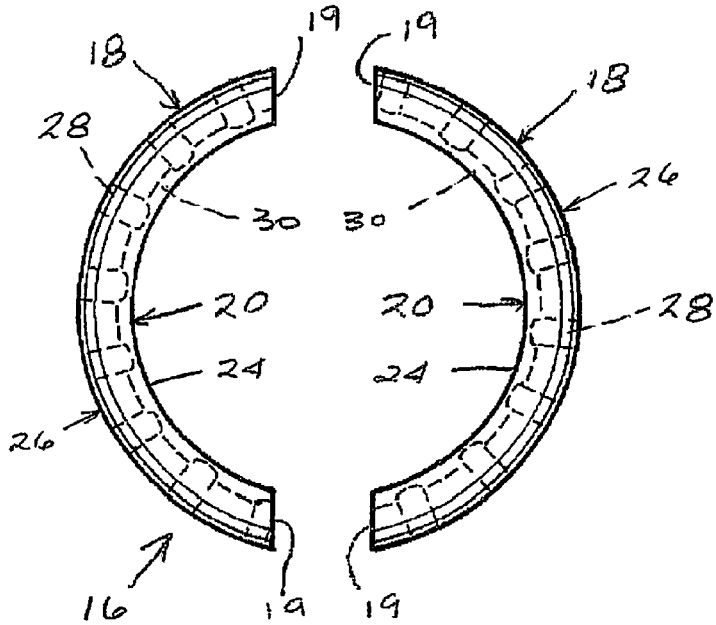
FIG. 5 is an axial end view of the band of FIG. 4.
Figure 6:
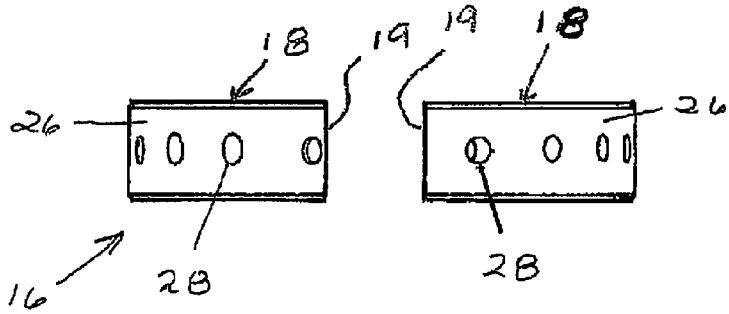
FIG. 6 is a side edge view of the band of FIG. 5.

Therapeutic glove 10 constructed in accordance with the present invention comprises a portion 12 that covers at least a part of the palm of the user's hand and finger portions 14 that cover at least the inner ends of the fingers adjacent the metacarpophalangeal joint (MCP joint) between the metacarpal bones in the palm of the hand and the phalanges bones forming the fingers and thumbs of the hand. A wrist strap 15 having a hook and loop fastener 17 or other fastener securely holds the glove on the user's hand. The glove is formed of a resilient elastic material that provides a resilient, snug engagement of the glove on the surface of the hand. A glove formed of a resilient fabric that has breathing characteristics is preferred. Resilient fabrics are known. A breathable resilient fabric that provides a snug fit on hands of a variety of sizes is desirable. A suitable fabric can be made from a natural or synthetic fiber or, desirably, the fabric can be a thin surgical stainless steel mesh fabric formed from thin surgical stainless steel fibers. The stainless steel fabric can be gold plated at least in finger joint areas to enhance the therapeutic benefits of the glove. Whatever flexible fabric is employed, the fabric also should be semi-elastic, flexible, hypoallergenic, breathable, washable and latex free. The snug, compression fit of the glove provides a measure of relief from the discomfort of arthritis.

The glove can have finger portions that cover the entire finger of a wearer, if desired. The finger portions can extend to cover any joints that are being influenced or are susceptible to being influenced by arthritis, particularly rheumatoid arthritis. For exemplary purposes, the glove of the exemplary embodiment of the invention is formed for the purpose of impeding the progress of rheumatoid arthritis in the MCP joint (between the fingers and the palm of a hand). The fingers 14 extend at least part of the way between the MCP joint and the adjacent finger joint, the proximal interphalangeal joint (the PIP joint). Expandable bands 16 are mounted on the finger portions 14 of the glove adjacent the MCP joint. Bands 16 desirably are split rings comprising at least two arcuate sections or segments 18. The arcuate sections 18 have ends 19 that can expand apart to fit fingers of different sizes. The inner surfaces 20 of sections 18 of bands 16 are arcuate so the bands slide easily on and off the fingers. The inner surfaces of the bands are covered with a layer 24 of high quality gold, preferably 18-24 carat gold and most desirably 24 carat gold. Preferably the gold forms a relatively thin layer on the inner surface of the ring segments 18, such that the gold layer is in direct contact with the skin on the finger of the wearer. The metal layer desirably is about 10-50 microns thick and preferably about 25-50 microns thick. The outer portion 26 of the band need not be formed of gold but may be formed of any suitable material, including metallic and non-metallic substances. A synthetic resin can be used. The ring segments 18 are formed so that they can be readily attached to the fingers 14 of glove 10. In the illustrated embodiment, the bands include stitch holes 28 spaced around the bands. These permit the segments to be sewn inside the fingers 14 of the glove, with the gold inner surface facing the finger of the wearer. A circumferential groove 30 can be formed on the inner side of the ring segments in order to permit the ring segments to be sewn in the fingers of the glove with a thread 31 recessed into the inner surface of the ring, so as to prevent the thread from impeding surface contact of the gold band 22 with the skin on the finger of the wearer. Any suitable thread 33 (FIG. 1) can be used to attach the ring segments to the fingers of the glove. Other attachment means can be employed, as long as the bond permits resilient expansion of the bands and ring fingers to accommodate hands and finger joints of different sizes, while still providing a resilient engagement of the ring with the outer surface of the finger.

In a second embodiment of the invention shown in FIGS. 8-11, split ring band 16' is substantially the same as split ring band 16 in the previous embodiment, with the exception that band 16' includes an upper arcuate section 50 that has a rearwardly extending flange 52 having a gold-coated inner surface 53 that extends adjacent to or over a portion of the MCP joint when the glove and ring are in position on the wearer's hand. In the exemplary embodiment, band 16' is about one quarter inch wide in an axial direction and the flange is about ⅜ inch wide. An inner edge 54 of the flange is desirably formed in an arcuate shape, with the arc having a circumference of about one-half inch. The remaining features of band 16' are substantially the same as band 16. Like features of bands 16 and 16' are given the same reference numerals, with the exception that the features shown in band 16' are marked with a prime mark.

The purpose of flange 52 is to extend the gold coated surface of the ring closer to or over at least a part of the MCP joint, so as to bring the gold coated material into more direct proximity to the inflamed MCP joint. Bringing the gold coated surface into closer proximity to the arthritic MCP joint improves the effectiveness of the device.

While a solid ring formed in two split arcuate sections is shown in the illustrated embodiments, other types of rings could be employed. For example, the ring can be formed in a larger number of segments, and the segments can be embedded in an elastic ring. Also, the gold can be applied in a variety of ways to the inner surface of the glove in order to provide a radially expandable resilient gold band that encircles and contacts the fingers of the user adjacent the afflicted joints. Also, the gold material can be applied to the inner surface of the glove at a position that is in direct contact with the afflicted joint. A spray deposition of gold on the inner surface of the ring is also feasible.

The important feature is that the high quality gold be brought in direct contact with the skin of the hand under some pressure at a position on or adjacent to the afflicted joint. The use of a split ring embedded in elastic fingers causes a continuous inner pressure between the gold surface on the ring segments and the fingers of the use. By using elastic fingers and split rings, the same glove can be used on different sizes of hands and the glove pressure enhances the gold contact with the skin and provides an independent therapeutic benefit.

While the exact mechanism of gold therapy for arthritis is not known, it is believed that particles of gold are deposited on the skin by abrasion of the gold band with the skin, and this gold penetrates the hand and impedes the symptoms of arthritis.

It should be understood that the foregoing is a description of an exemplary embodiment of the present invention and that various changes in the arrangements and details of construction of the embodiments disclosed herein may be made without departing from the spirit and scope of the present invention.

What is claimed is:

1. A therapeutic arthritis glove for impeding arthritic degeneration of finger joints, comprising:

a glove having resiliently expandable finger portions that extend at least partially over the proximal phalanges at a position adjacent the MCP joint on one or more fingers a radially expandable band comprising gold on an inner surface thereof, the band being positioned in one or more resilient finger portions of the glove adjacent the MCP joint, such that the inner side of the band is in contact with the exterior surface of the wearer's finger in proximity to the MCP joint, the band being expandable such that the inner side of the gold band is in resilient engagement with the fingers so as to impart a therapeutic benefit to the MCP joint that impedes the progress of arthritis in the joint.

2. A therapeutic glove for alleviating the effects of arthritis in finger joints comprising:

a glove that fits at least partly over the affected hand of the user, with the glove having finger portions that extend to a position adjacent to the affected finger joint, the finger portions being formed of an elastic material;

an expandable ring mounted in the resilient finger portions of the glove adjacent the affected joint, the ring being resiliently expandable such that the ring can be fitted over finger joints and fingers of different sizes, such that the ring snugly engages the fingers of the wearer; and an expandable layer of gold positioned on the inside surface of the ring, such that the gold is pressed snugly against the finger of the wearer adjacent the affected joint when the glove is worn.

3. A therapeutic glove as in claim 2 wherein the ring comprises a plurality of ring segments individually mounted in the elastic finger portions of the glove, the segments being expandable to permit the ring to fit snugly on fingers of different sizes.

4. A therapeutic glove as in claim 3 wherein the ring segments are arcuate in shape.

5. A therapeutic glove as in claim 2 wherein the ring segments have a plurality of radial holes therethrough spaced around the periphery of the ring, and the ring is sewn to the inside surface of the grooved fingers by threads that extend through the ring segment openings.

6. A therapeutic glove as in claim 5 wherein the inner surface of the ring segments adjacent the surface of the wearer's hand have recessed, circumferentially extending grooves therein, such that when the ring segments are sewn in the fingers of the glove, the threads are recessed in the inner surface of the ring and do not impede contact between the gold on the inner surface of the ring segments and the fingers of the wearer.

7. A therapeutic glove as in claim 2 wherein the gold is 18 karat or higher.

8. A therapeutic glove as in claim 7 wherein the gold is about 24 karat.

* * * * *